US008702454B2

(12) United States Patent
Hamada

(10) Patent No.: US 8,702,454 B2
(45) Date of Patent: Apr. 22, 2014

(54) CONTACT AND CONNECTOR WITH CONTACTS

(71) Applicant: Yazaki Corporation, Tokyo (JP)

(72) Inventor: Keiji Hamada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/908,477

(22) Filed: Jun. 3, 2013

(65) Prior Publication Data

US 2013/0267122 A1 Oct. 10, 2013

Related U.S. Application Data

(63) Continuation of application No. PCT/JP2012/051008, filed on Jan. 11, 2012.

(30) Foreign Application Priority Data

Jan. 11, 2011 (JP) ..... 2011-003165

(51) Int. Cl.
*H01R 13/40* (2006.01)

(52) U.S. Cl.
USPC ..... 439/733.1

(58) Field of Classification Search
USPC ..... 439/626, 733.1
See application file for complete search history.

(56) References Cited

U.S. PATENT DOCUMENTS 3,897,131 A * 7/1975 Stauffer ..... 439/655
5,403,215 A * 4/1995 Buchter et al. ..... 439/869
5,897,401 A * 4/1999 Fili et al. ..... 439/733.1
6,042,429 A * 3/2000 Bianca et al. ..... 439/733.1
6,048,232 A * 4/2000 Chen ..... 439/733.1
6,261,132 B1 * 7/2001 Koseki et al. ..... 439/733.1
7,083,478 B1 * 8/2006 Kutsuna et al. ..... 439/733.1
7,179,123 B2 2/2007 Ohara
2005/0074999 A1 4/2005 Ohara

FOREIGN PATENT DOCUMENTS

JP 2008-270179 A 11/2008

OTHER PUBLICATIONS

International Search Report and Written Opinion of the International Search Report for PCT/JP2012/051008 dated May 31, 2012.

* cited by examiner

*Primary Examiner* — Neil Abrams
*Assistant Examiner* — Travis Chambers
(74) *Attorney, Agent, or Firm* — Kenealy Vaidya LLP

(57) ABSTRACT

A connector is provided to press-fit terminals in terminal-press-fitting holes of a housing, and electric contact parts of contacts are aligned in respective terminal-alignment grooves in the housing. A pair of concave pressed parts and a pair of curved convex parts are formed on opposite surfaces of the press-fit fixing part, respectively. The pair of concave pressed parts and the pair of curved convex parts are provided on opposite lateral ends of the press-fit fixing part with a predetermined gap to each remain a non-deformed part between the pair of concave pressed parts and between the pair of curved convex parts to be flat so that a first area of the second surface on which the non-deformed part is remained is flush with a second area continuous to the first area in the longitudinal direction of the press-fit fixing part.

3 Claims, 7 Drawing Sheets

CONTACT AND CONNECTOR WITH CONTACTS

CROSS REFERENCE TO RELATED APPLICATIONS

This application is a continuation of PCT application No. PCT/JP2012/051008, which was filed on Jan. 11, 2012 based on Japanese Patent Application (No. 2011-003165) filed on Jan. 11, 2011, the contents of which are incorporated herein by reference.

BACKGROUND OF THE INVENTION

1. Field of the Invention

The present invention relates to a contact and a connector with contacts in which contacts are press-fitted in terminal-press-fitting holes of a housing from a rear side, respectively, and electric contact parts (parts to be slid on and contact with terminals of a mating connector) provided at a leading end side of the contacts are inserted and aligned in terminal-alignment grooves on a surface of a thin-plate insulator that is projected integrally with a front portion of the housing.

2. Description of the Related Art

As an example of this type of the connector, an HDMI connector described in JP2008-270179A is known, for example.

FIG. 5 shows an external appearance of a connector that is similar to the connector described in JP2008-270179A. A connector 1 includes a housing 2 that is integrally molded with an insulating resin, and contacts 10 that are aligned in two stages of an upper stage and a lower stage.

Each contact 10 is press-fitted from a rear side in a terminal-press-fitting hole 3 that is formed in the housing 2. Each electric contact part 15 provided at a leading end side of the contact 10 is inserted and aligned in a terminal-alignment groove 5 on upper and lower surfaces (a surface) of a thin-plate insulator 4 that is projected integrally with a front portion of the housing 2. Each of the terminal-press-fitting holes 3 and the terminal-alignment grooves 5 are communicated with each other as a straight way. The terminal-press-fitting hole 3 is formed in a rectangle in cross-section and the terminal-alignment groove 5 is formed in a rectangular groove in cross-section.

FIG. 6 is a perspective view showing an entire configuration of contacts 10 that are used in the connector in the related art. FIG. 7 is an enlarged perspective view of a part surrounded by a two-dot chain line in FIG. 6. FIG. 8 is an enlarged perspective view reversely showing a part indicated in FIG. 7. Each of the contacts 10 is formed in a plate shape having a rectangle in cross-section, and the contacts 10 are aligned at a constant pitch in a lateral direction on the upper stage and the lower stage. The contacts 10 aligned on the upper stage and those aligned on the lower stage are oppositely oriented except for rear foot parts 16 for connecting to a circuit board at a most rear side.

Each contact 10 is formed in a rectangular shape in cross-section in a slightly smaller size than a cross-sectional size of the terminal-press-fitting hole 3. The contact 10 includes an electric contact part 15 which is inserted and aligned in the terminal-alignment groove 5 of the insulator 4 of the housing 2 at a leading end side, a press-fit fixing part 11 which is press-fitted from a rear side and fixed in the terminal-press-fitting hole 3 at a rear side of the electric contact part 15, and the rear foot part 16 at a most rear side.

A lateral width D1 of a normal-width part of the press-fit fixing part 11 is smaller than a lateral width dimension of the cross-section of the terminal-press-fitting hole 3. At a latter part (rear side) of the press-fit fixing part 11 in the longitudinal direction, a wide-width part 12 having a width D2 which is larger than the lateral width dimension of the cross-section of the terminal-press-fitting hole 3 is provided. Inclined walls 13 are provided at right and left surfaces of a transitional part between the normal-width part having the width D1 and the wide-width part 12 having the width D2 to facilitate the press-fitting of the wide-width part 12 into the terminal-press-fitting hole 3.

When the contacts 10 are attached to the housing 2, it is assumed, in each of the contacts 10, that an outer side surface which contacts an inner bottom surface 5*b* of the terminal-alignment groove 5 is a lower surface 10*b*, an outer side surface which is opposite to the lower surface 10*b* is an upper surface 10*a*, and right and left outer side surfaces are right and left side surfaces 10*c*, and it is assumed that an inner wall of the terminal-press-fitting hole 3 that faces the upper surface 10*a* of the contact is an upper wall 3*a*, and an inner wall of the terminal-press-fitting hole 3, opposite to the upper wall 3*a*, which faces the lower surface 10*b* of the contact 10 is an lower wall 3*b*. In this case, the upper wall 3*a* and the lower wall 3*b* of the terminal-press-fitting hole 3 exist in a vertical direction orthogonal to the lateral direction in which the contacts 10 are aligned.

Here, although only the relation between the contacts 10 on the upper stage and the terminal-press-fitting holes 3 on the upper stage is described, the relation between the contacts 10 and the terminal-press-fitting holes 3 on the lower stage is that only the up/down orientation is reversed with respect to the case of the upper stage, and the designation names of the upper surface 10*a*, the lower surface 10*b*, the upper wall 3*a* and the lower wall 3*b* are the same as those in the upper stage.

FIG. 9A is a cross-sectional view showing a state in which the contacts 10 are attached to the housing 2 in the related art, and FIG. 9B is an enlarged view of a main part of the state indicated in FIG. 9A.

On the upper surface 10*a* of the press-fit fixing part 11 of the contact 10, arch-shaped curved convex parts 20 which press-contacts the upper wall 3*a* of the terminal-press-fitting hole 3 are provided at two locations separate away from each other in the longitudinal direction (front-back direction) of the contact 10 by forming concave pressed parts 21 on the lower surface 10*b* of the contact 10. Each of the curved convex part 20 is formed along an entire range in width direction of the contact 10. Where a height from the lower wall 3*b* to the upper wall 3*a* of the terminal-press-fitting hole 3 is H3, a height H1 from the lower surface 10*b* to the upper surface 10*a* of the contact 10 is set so as to satisfy the relation of H1<H3. Further, a height H2 from the lower surface 10*b* to a top of the curved convex part 20 of the contact 10 is set so as to satisfy the relation of H2>H3.

Accordingly, when the press-fit fixing part 11 of the contact 10 is press-fitted in the terminal-press-fitting hole 3 from a rear side, the top of the curved convex part 20 of the contact 10 press-contacts the upper wall 3*a* of the terminal-press-fitting hole 3. The lower surface 10*b* of the contact 10 can be, therefore, closely contact with the lower wall 3*b* of the terminal-press-fitting hole 3 and the inner bottom surface 5*b* of the terminal-alignment groove 5 until the lower surface 10*b* of the contact 10 reaches a leading end 15*a* of the electric contact part 15 from the press-fit fixing part 11. In this way, it is possible to prevent the attached contact 10 from being rattling in the vertical direction.

Further, when the press-fit fixing part 11 of the contact 10 is press-fitted in the terminal-press-fitting hole 3, the wide-width part 12 of the press-fit fixing part 11 is press-contacted with the lateral side walls of the terminal-press-fitting hole 3. Accordingly, it is possible to prevent the contact 10 from being rattling in the lateral direction, i.e., in the alignment direction.

SUMMARY OF THE INVENTION

When the contact 10 is press-fitted in the terminal-press-fitting hole 3 of the housing in practical use, it is found that the following phenomenon may be caused. That is, when the curved convex part 20 of the contact 10 is press-contacted with the upper wall 3*a* of the terminal-press-fitting hole 3 by press-fitting, the curved convex part 20 is slightly deformed by a reaction force from the upper wall 3*a* of the terminal-press-fitting hole 3. Due to the force in the deformation, the phenomenon may be caused in which a front edge part 21*a* of the concaved pressed part 21 serves as a fulcrum, and as shown in FIG. 10, the electric contact part 15 at the leading end side of the contact 10 is raised from the inner bottom surface 5*b* of the terminal-alignment groove 5.

When the raising occurs, if the connector 1 is to be engaged with a mating connector 50 without any countermeasure, the leading end 15*a* of the electric contact part 15 of the contact may collide with a leading end of a terminal 52 of the mating connector 50 (see a part indicated by a two-dot chain line in FIG. 10), and therefore the terminal 52 may be bent, the engagement of the connectors may be failed.

The present invention has been made in view of the above circumstance, and an object of the present invention is to provide a contact and a connector with contacts for preventing a raising of a leading end of a press-fitted contact and enabling an engagement of the connector with a mating connector surely.

In order to solve the above object, a connector according to aspects of the invention is indicated as the following configurations (1) to (3).

(1) A contact to be inserted in a housing, the contact including:

an electric contact part to be electrically connected to a terminal of a mating connector when the contact is inserted in the housing;

a press-fit fixing part that is continuously extended from the electric contact part in a longitudinal direction;

a pair of concave pressed parts formed on a first surface of the press-fit fixing part; and a pair of curved convex parts formed on a second surface opposite to the first surface of the press-fit fixing part corresponding to the pair of concave pressed parts, wherein the pair of concave pressed parts and the pair of curved convex parts are provided on opposite lateral ends of the press-fit fixing part with a predetermined gap to each remain a non-deformed part between the pair of concave pressed parts and between the pair of curved convex parts to be flat so that a first area of the second surface on which the non-deformed part is remained is flush with a second area continuous to the first area in the longitudinal direction of the press-fit fixing part.

(2) The contact according to claim 1, wherein a second pair of concave pressed parts and a second pair of curved convex parts are provided so that the second pair of concave pressed parts and the pair of concave pressed parts, and the pair of curved convex parts and the second pair of curved convex parts are provided separately away from each other in the longitudinal direction of the press-fit fixing part.

(3) A connector, including:

a housing that includes, at a front side, a thin-plate insulator on which a plurality of terminal-alignment grooves are extended in a longitudinal direction of the housing, and includes, at a rear side, a terminal-press-fitting hole formed in a rectangular cross-section that is communicated with the respective terminal-alignment grooves as a straight way; and a plurality of contacts as defined in the configuration (1) or (2), each of the contacts being in a slightly smaller size than a cross-sectional size of the terminal-press-fitting hole, wherein when the contacts are attached to the housing, where an outer side surface of the contact which contacts a bottom surface of the terminal-alignment groove is a lower surface, an outer side surface which is opposite to the lower surface is an upper surface, an inner wall of the terminal-press-fitting hole that faces the upper surface of the contact is an upper wall, and an inner wall of the terminal-press-fitting hole, opposite to the upper wall, which faces the lower surface of the contact is an lower wall, the upper wall and the lower wall of the terminal-press-fitting hole exist in a vertical direction orthogonal to a lateral direction in which the contacts are aligned, and the pair of concave pressed parts is formed on the upper surface of each of the contacts, and the pair of curved convex parts is formed on the lower surface of each of the contacts.

According to the contact or the connector provided with contacts as configured in any one of (1) to (3), since the non-deformed part is remained between the pair of curved convex parts provided on opposite lateral ends on the upper surface of the contact, and the lower surface of the non-deformed part is caused to be flush with the lower surface of the contact which is continuous to the lower surface in the longitudinal direction, the lower surface of the non-deformed part can be closely contact with the lower wall of the terminal-press-fitting hole continuously as well as the lower surface of the contact which is continuous to the lower surface in the longitudinal direction. Accordingly, the lower surface of the non-deformed part can hold on the upper wall of the terminal-press-fitting hole. In summary, due to the existence of the non-deformed part, it is possible to regulate the up/down movement of the curved convex part, thereby preventing the electric contact part at a leading end side ahead of the curved convex part from being raised from the inner bottom surface of the terminal-alignment groove. As a result, the connector can avoid to be collided with the terminal of the mating connector, and the engagement of the connector with the mating connector can be ensured.

According to the aspects of the invention, it becomes possible to prevent a raising of the leading end of the press-fitted contact, and engage the connector with the mating connector surely.

The aspects of the present invention have been simply explained. The present invention should be clarified further in detail by reading the description of an embodiment as explained below with reference to the accompanying drawings.

DETAILED DESCRIPTION OF THE EXEMPLARY EMBODIMENTS

An embodiment of the invention is described below with reference to the drawings.

Figure 1:
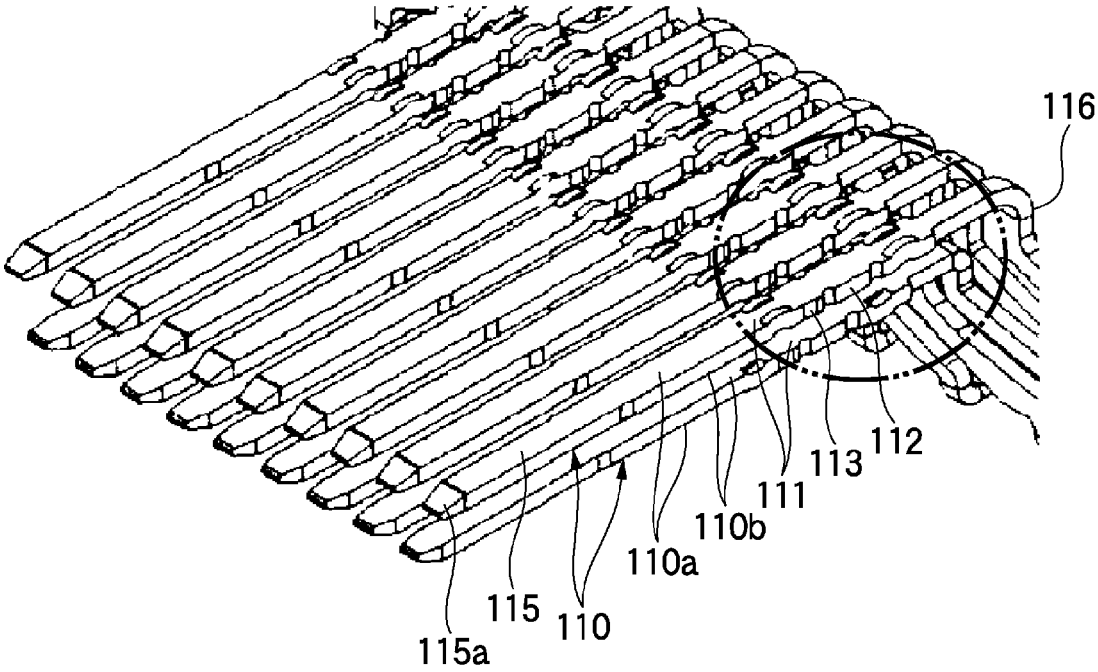
FIG. 1 is a perspective view showing an entire configuration of contacts that are used in a connector according to an embodiment of the invention.
Figure 2:
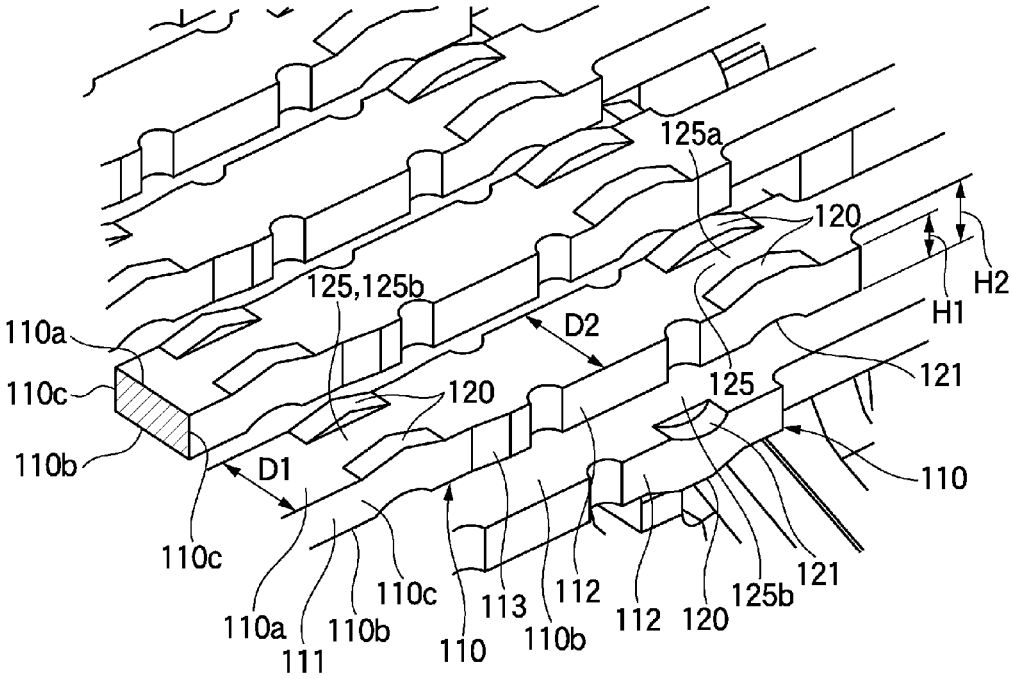
FIG. 2 is an enlarged perspective view of a main part in FIG. 1.
Figure 3:
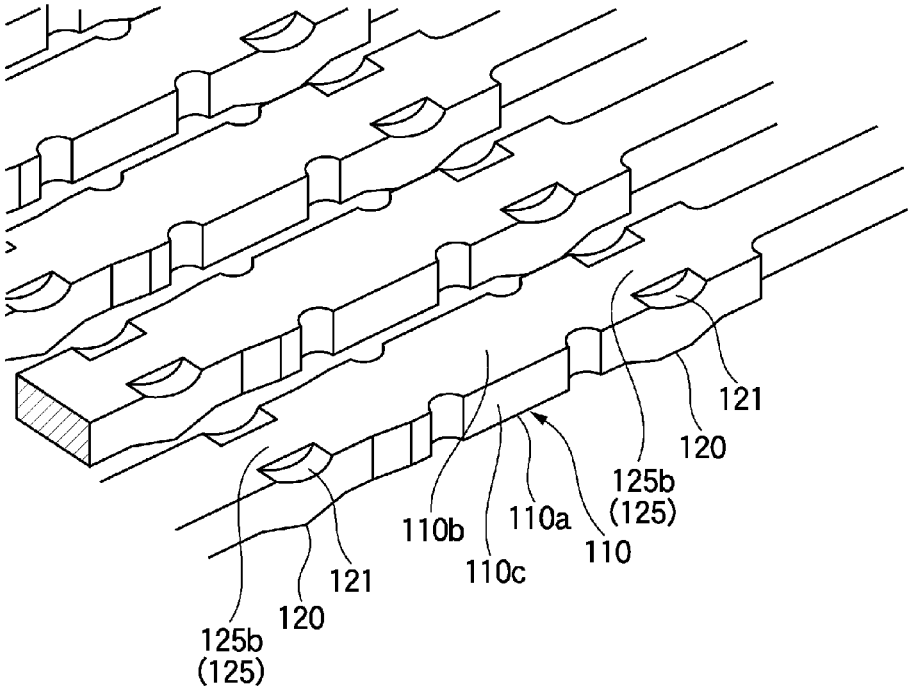
FIG. 3 is an enlarged perspective view reversely showing a part indicated in FIG. 2.
Figure 4A:
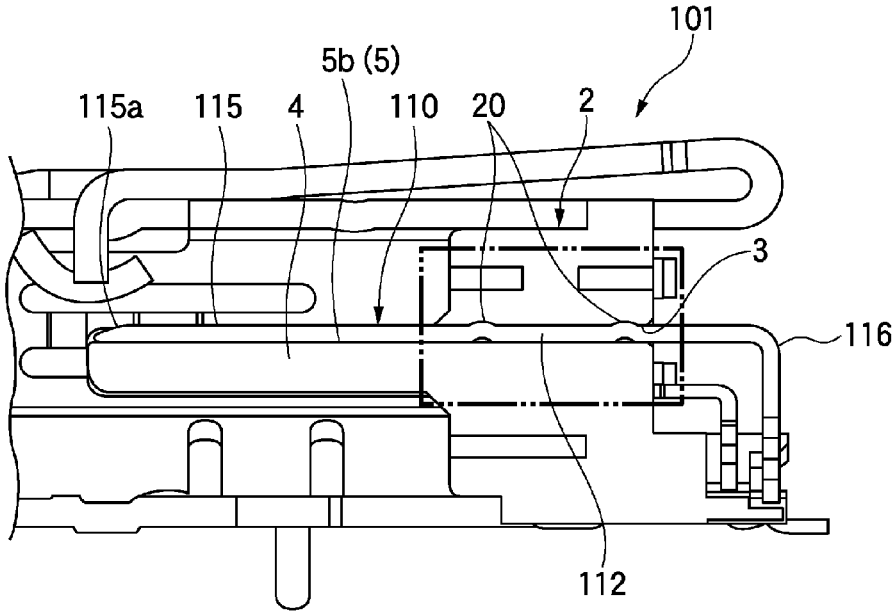
FIG. 4A is a cross-sectional view showing a state in which the contacts are attached to a housing according to the embodiment of the invention.
Figure 4B:
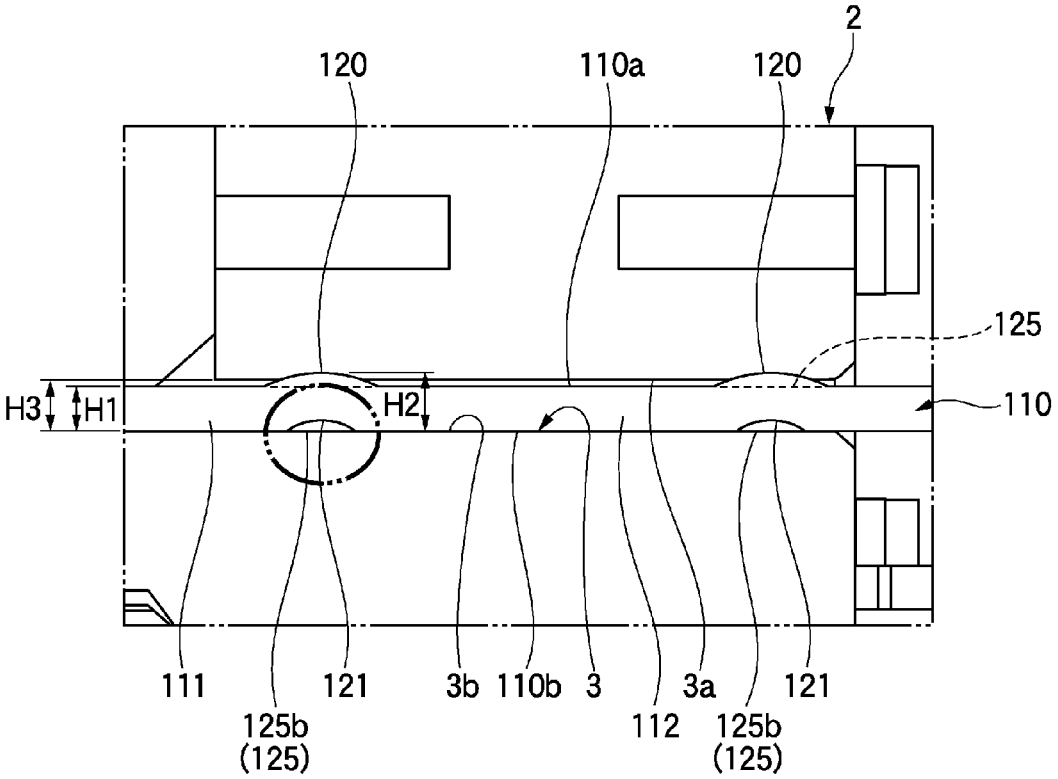
FIG. 4B is an enlarged view of a main part of the state indicated in FIG. 4A.
Figure 5:
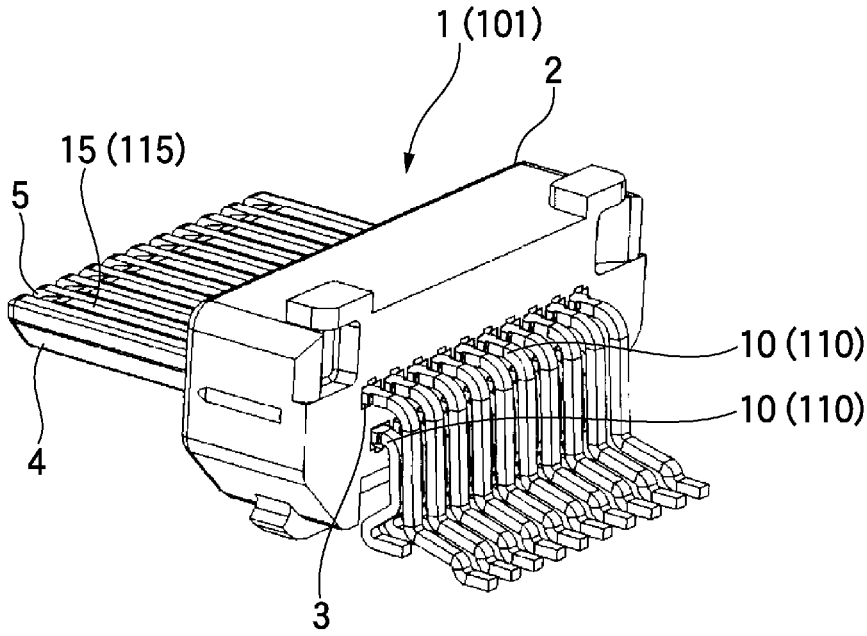
FIG. 5 is a perspective view commonly showing external appearances of a connector in a related art and a connector according to the embodiment of the invention.
Figure 6:
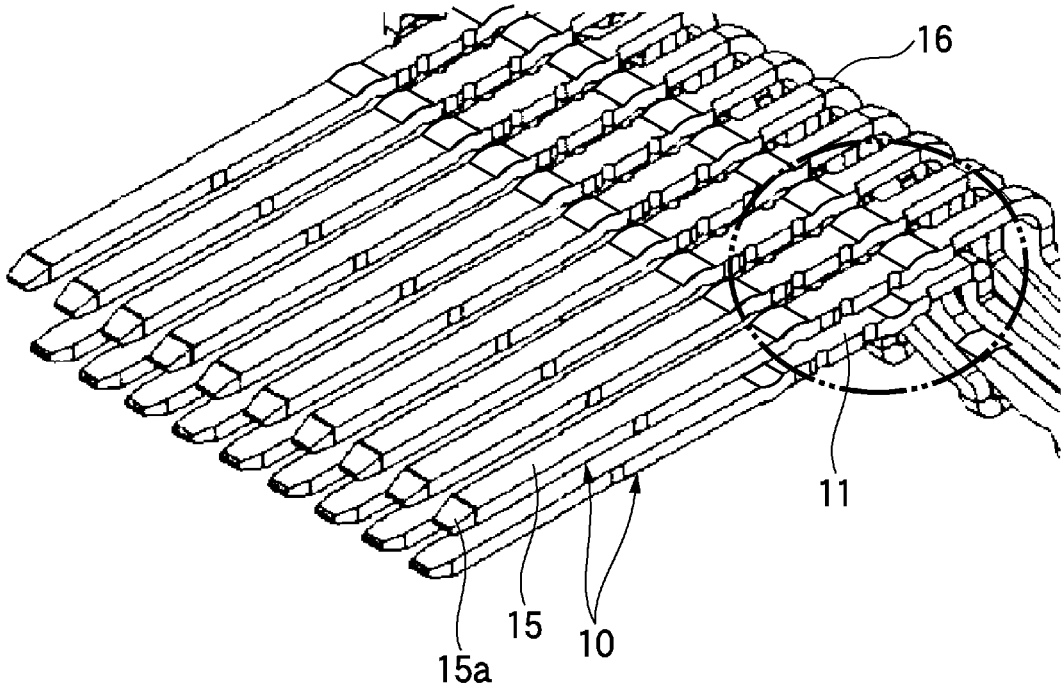
FIG. 6 is a perspective view showing an entire configuration of contacts that are used in the connector in the related art.
Figure 7:
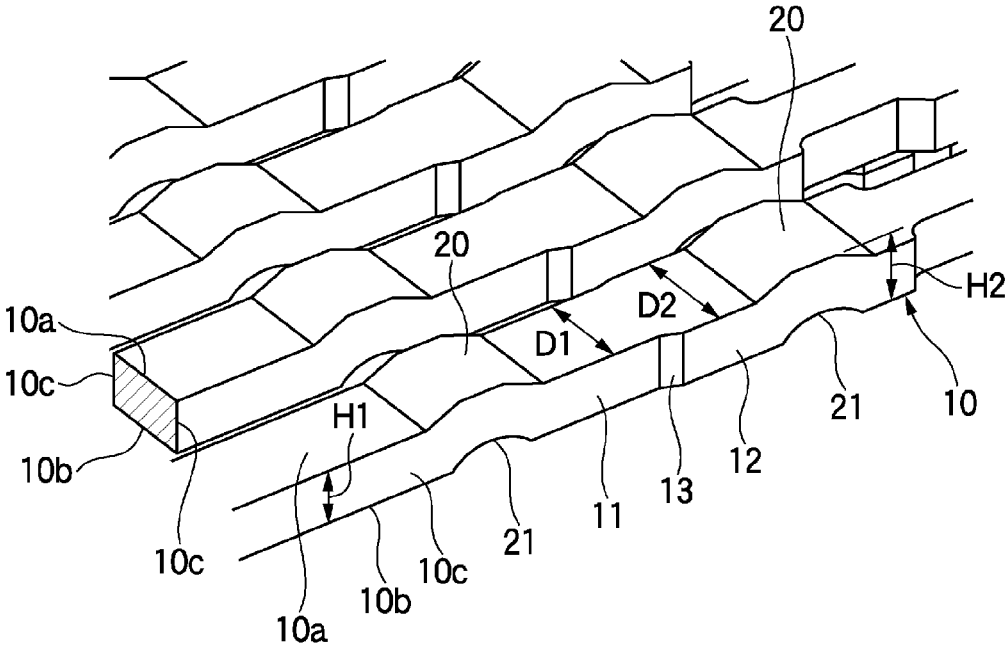
FIG. 7 is an enlarged perspective view of a main part in FIG. 6.
Figure 8:
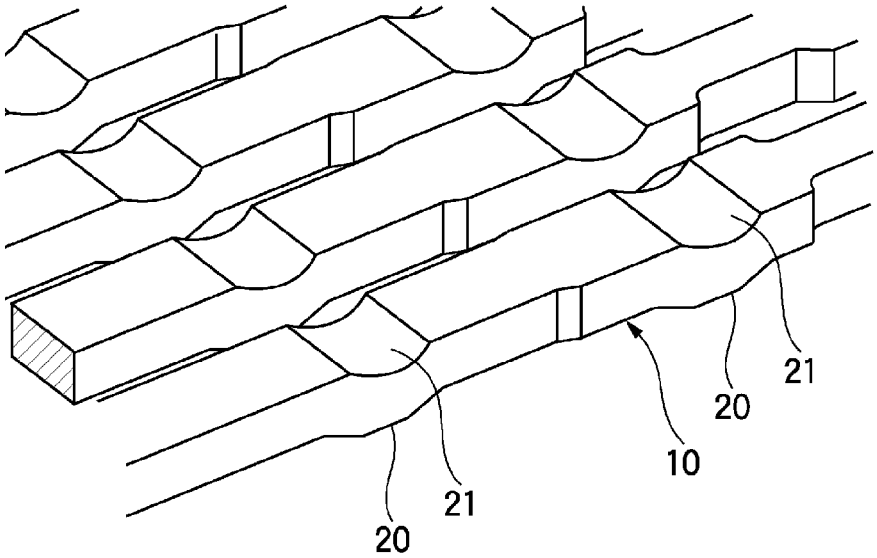
FIG. 8 is an enlarged perspective view reversely showing a part indicated in FIG. 7.
Figure 9A:
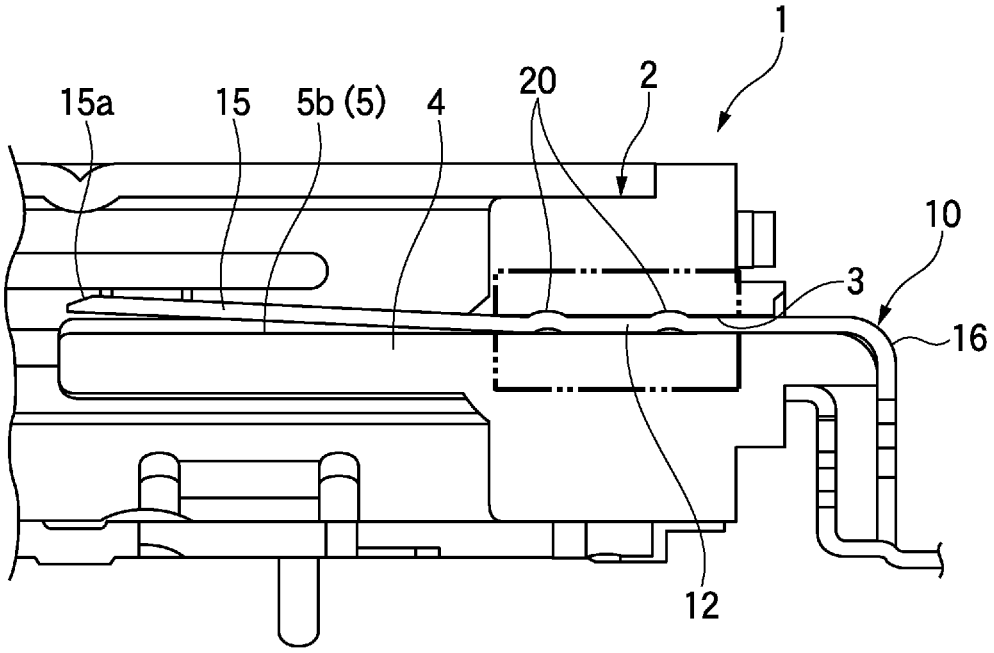
FIG. 9A is a cross-sectional view showing a state in which the contacts are attached to a housing in the related art.
Figure 9B:
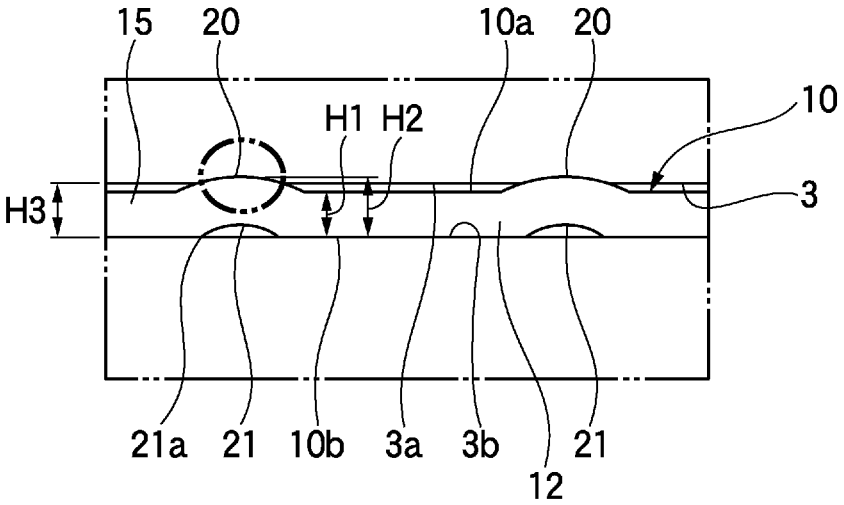
FIG. 9B is an enlarged view of a main part of the state indicated in FIG. 9A.
Figure 10:
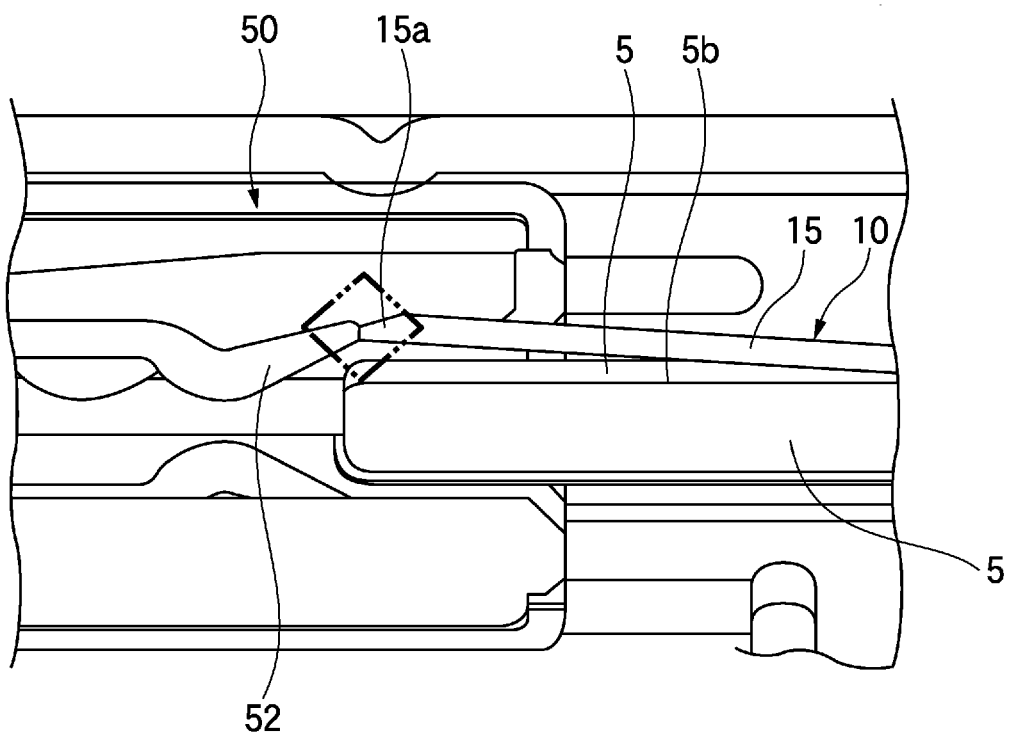
FIG. 10 is an enlarged view showing a problem which occurs in the connector in the related art.

FIG. 1 is a perspective view showing an entire configuration of contacts that are used in a connector according to the embodiment of the invention. FIG. 2 is an enlarged perspective view of a main part in FIG. 1. FIG. 3 is an enlarged perspective view reversely showing a part indicated in FIG. 2. FIG. 4A is a cross-sectional view showing a state in which the contacts are attached to a housing according to the embodiment of the invention. FIG. 4B is an enlarged view of a main part of the state indicated in FIG. 4A. FIG. 5 is referred to for an external configuration of the connector.

As shown in FIG. 5, a connector 101 includes a housing 2 that is integrally molded with an insulating resin, and contacts 110 that are aligned in two stages of an upper stage and a lower stage.

Each contact 110 is press-fitted from a rear side in a terminal-press-fitting hole 3 that is formed in the housing 2. Each electric contact part 115 provided at a leading end side of the contact 110 is inserted and aligned in a terminal-alignment groove 5 on upper and lower surfaces (a surface) of a thin-plate insulator 4 that is projected integrally with a front portion of the housing 2. Each of the terminal-press-fitting holes 3 and the terminal-alignment grooves 5 are communicated with each other as a straight way. The terminal-press-fitting hole 3 is formed in a rectangle in cross-section and the terminal-alignment groove 5 is formed in a rectangular groove in cross-section.

As shown in FIGS. 1 to 3, each of the contacts 110 is formed in a plate shape having a rectangle in cross-section, and the contacts 110 are aligned at a constant pitch in a lateral direction on the upper stage and the lower stage. The contacts 110 aligned on the upper stage and those aligned on the lower stage are oppositely oriented except for rear foot parts 116 for connecting to a circuit board at a most rear side.

Each contact 110 is formed in a rectangular shape in cross-section in a slightly smaller size than a cross-sectional size of the terminal-press-fitting hole 3. The contact 110 includes an electric contact part 115 which is inserted and aligned in the terminal-alignment groove 5 of the insulator 4 of the housing 2 at a leading end side, a press-fit fixing part 111 which is press-fitted from a rear side and fixed in the terminal-press-fitting hole 3 at a rear side of the electric contact part 15, and the rear foot part 16 at a most rear side.

A lateral width D1 of a normal-width part of the press-fit fixing part 111 is smaller than a lateral width dimension of the cross-section of the terminal-press-fitting hole 3. At a latter part (rear side) of the press-fit fixing part 111 in the longitudinal direction, a wide-width part 112 having a width D2 which is larger than the lateral width dimension of the cross-section of the terminal-press-fitting hole 3 is provided. Inclined walls 113 are provided at right and left surfaces of a transitional part between the normal-width part having the width D1 and the wide-width part 112 having the width D2 to facilitate the press-fitting of the wide-width part 112 into the terminal-press-fitting hole 3.

As shown in FIG. 4A and 4B, when the contacts 110 are attached to the housing 2, it is assumed, in each of the contacts 110, that an outer side surface which contacts an inner bottom surface 5*b* of the terminal-alignment groove 5 is a lower surface 110*b*, an outer side surface which is opposite to the lower surface 110*b* is an upper surface 110*a*, and right and left outer side surfaces are right and left side surfaces 110*c*, and it is assumed that an inner wall of the terminal-press-fitting hole 3 that faces the upper surface 110*a* of the contact is an upper wall 3*a*, and an inner wall of the terminal-press-fitting hole 3, opposite to the upper wall 3*a*, which faces the lower surface 110*b* of the contact 110 is an lower wall 3*b*. In this case, the upper wall 3*a* and the lower wall 3*b* of the terminal-press-fitting hole 3 exist in a vertical direction orthogonal to the lateral direction in which the contacts 110 are aligned.

Here, although only the relation between the contacts 110 on the upper stage and the terminal-press-fitting holes 3 on the upper stage is described, the relation between the contacts 110 and the terminal-press-fitting holes 3 on the lower stage is that only the up/down orientation is reversed with respect to the case of the upper stage, and the designation names of the upper surface 110*a*, the lower surface 110*b*, the upper wall 3*a* and the lower wall 3*b* are the same as those in the upper stage.

On the upper surface 110*a* of the press-fit fixing part 111 of the contact 110, arch-shaped curved convex parts 120 which press-contacts the upper wall 3*a* of the terminal-press-fitting hole 3 are provided at two locations separate away from each other in the longitudinal direction (front-back direction) of the contact 110 by forming concave pressed parts 121 on the lower surface 110*b* of the contact 110. In this embodiment, each of the curved convex part 120 is formed on the upper surface on opposite lateral ends of the contact 110 with a predetermined gap (that is, a pair (right and left) of curved convex parts 120 is formed), a non-deformed part 125 is remained to be flat between the pair of curved convex parts 120, 120 provided on opposite lateral ends. An upper surface 125*a* and a lower surface 125*b* of the remained non-deformed part 125 are flush with the upper surface 110*a* and the lower surface 110*b* of the contact 110 which are continuous to the upper surface 125*a* and the lower surface 125*b* in the longitudinal direction, respectively.

In this case, where a height from the lower wall 3*b* to the upper wall 3*a* of the terminal-press-fitting hole 3 is H3, a height H1 from the lower surface 110*b* to the upper surface 110*a* of the contact 110 is set so as to satisfy the relation of H1<113. Further, a height H2 from the lower surface 110*b* to a top of the curved convex part 120 of the contact 110 is set so as to satisfy the relation of H2>H3.

Accordingly, when the press-fit fixing part 111 of the contact 110 is press-fitted in the terminal-press-fitting hole 3 from a rear side, the top of the curved convex part 120 of the contact 110 press-contacts the upper wall 3*a* of the terminal-press-fitting hole 3. The lower surface 110*b* of the contact 110 can be, therefore, closely contact with the lower wall 3*b* of the terminal-press-fitting hole 3 and the inner bottom surface 5*b* of the terminal-alignment groove 5 until the lower surface 110*b* of the contact 110 reaches a leading end 115*a* of the electric contact part 115 from the press-fit fixing part 111. In this way, it is possible to prevent the attached contact 110 from being rattling in the vertical direction.

Especially, since the non-deformed part 125 is remained between the pair of curved convex parts 120, 120 provided on opposite lateral ends on the upper surface of the contact 110, and the lower surface 125*b* of the non-deformed part 125 is caused to be flush with the lower surface 110*b* of the contact 110 which is continuous to the lower surface 125*b* in the longitudinal direction, the lower surface 125*b* of the non-deformed part 125 can be closely contact with the lower wall 3*b* of the terminal-press-fitting hole 3 continuously as well as the lower surface 110*b* of the contact 110 which is continuous to the lower surface 125*b* in the longitudinal direction. Accordingly, the lower surface 125*b* of the non-deformed part 125 can hold on the upper wall 3*a* of the terminal-press-fitting hole 3.

In summary, due to the existence of the non-deformed part 125, it is possible to regulate the up/down movement of the curved convex part 120, thereby preventing the electric contact part 115 at a leading end side ahead of the curved convex part 120 from being raised from the inner bottom surface 5*b* of the terminal-alignment groove 5. As a result, the connector can avoid to be collided with the terminal of the mating connector, and the engagement of the connector with the mating connector can be ensured. Further, since the tops of the four curved convex parts 120 which are separate away from one another press-contact the upper wall 3*a* of the terminal-press-fitting hole 3, it is possible to press the contact 110 on the lower wall 3*b* of the terminal-press-fitting hole 3 stably.

Further, when the press-fit fixing part 111 of the contact 110 is press-fitted in the terminal-press-fitting hole 3, the wide-width part 112 of the press-fit fixing part 111 is press-contacted with the lateral side walls of the terminal-press-fitting hole 3. Accordingly, it is possible to prevent the contact 110 from being rattling in the lateral direction, i.e., in the alignment direction.

The invention is not limited to the aforesaid embodiment and may be suitably modified and improved. The material, shape, size, number, disposed position etc. of each of the constituent elements of the aforesaid embodiment are not limited thereto and may be arbitrary so long as the invention is attained.

What is claimed is:

1. A contact to be inserted in a housing, the contact comprising:

an electric contact part to be electrically connected to a terminal of a mating connector when the contact is inserted in the housing;

a press-fit fixing part that is continuously extended from the electric contact part in a longitudinal direction;

a pair of concave pressed parts formed on a first surface of the press-fit fixing part; and a pair of curved convex parts formed on a second surface opposite to the first surface of the press-fit fixing part corresponding to the pair of concave pressed parts, wherein each of the pair of concave pressed parts is provided on a respective opposite lateral end of the press-fit fixing part and spaced apart at a first predetermined gap so that a first area of the first surface that encompasses the first predetermined gap is flush with a second area that abuts the first area of the first surface, and each of the pair of curved convex parts is provided on a respective opposite lateral end of the press-fit fixing part and spaced apart at a second predetermined gap such that a first area of the second surface that encompasses the second predetermined gap is flush with a second area of the second surface that abuts the first area of the second surface.

2. The contact according to claim 1, wherein a second pair of concave pressed parts and a second pair of curved convex parts are provided so that the second pair of concave pressed parts and the pair of concave pressed parts, and the pair of curved convex parts and the second pair of curved convex parts are provided separately away from each other in the longitudinal direction of the press-fit fixing part.

3. A connector, comprising:

a housing that includes, at a front side, a thin-plate insulator on which a plurality of terminal-alignment grooves are extended in a longitudinal direction of the housing, and includes, at a rear side, a terminal-press-fitting hole formed in a rectangular cross-section that is communicated with the respective terminal-alignment grooves as a straight way; and a plurality of contacts as defined in claim 1, each of the contacts being in a slightly smaller size than a cross-sectional size of the terminal-press-fitting hole, wherein when the contacts are attached to the housing, where an outer side surface of the contact which contacts a bottom surface of the terminal-alignment groove is a lower surface, an outer side surface which is opposite to the lower surface is an upper surface, an inner wall of the terminal-press-fitting hole that faces the upper surface of the contact is an upper wall, and an inner wall of the terminal-press-fitting hole, opposite to the upper wall, which faces the lower surface of the contact is an lower wall, the upper wall and the lower wall of the terminal-press-fitting hole exist in a vertical direction orthogonal to a lateral direction in which the contacts are aligned, and the pair of concave pressed parts is formed on the upper surface of each of the contacts, and the pair of curved convex parts is formed on the lower surface of each of the contacts.

* * * * *